US005588809A

United States Patent [19]

Klein et al.

[11] Patent Number: 5,588,809

[45] Date of Patent: Dec. 31, 1996

[54] METERING PUMP WITH A VENT VALVE

[75] Inventors: Joachim Klein, Vachendorf; Herbert Hunklinger, Siegsdorf, both of Germany

[73] Assignee: Lang Apparatebau GmbH, Siegsdorf, Germany

[21] Appl. No.: 448,516

[22] PCT Filed: Nov. 27, 1993

[86] PCT No.: PCT/EP93/03333

§ 371 Date: Aug. 7, 1995

§ 102(e) Date: Aug. 7, 1995

[87] PCT Pub. No.: WO94/13956

PCT Pub. Date: Jun. 23, 1994

[30] Foreign Application Priority Data

Dec. 5, 1992 [DE] Germany ..... 42 41 030.4

[51] Int. Cl.[6] ..... F04B 21/00

[52] U.S. Cl. ..... 417/283; 417/296; 417/297; 417/307

[58] Field of Search ..... 417/283, 296, 417/297, 307

[56] References Cited

U.S. PATENT DOCUMENTS

| | | | |
|---|---|---|---|
| 3,680,985 | 8/1972 | Ginsberg et al. | 417/502 |
| 3,870,436 | 3/1975 | Remy | 417/299 |
| 4,507,054 | 3/1985 | Schoenmeyr | 417/296 X |
| 4,776,771 | 10/1988 | Kern | 417/307 |
| 4,865,525 | 9/1989 | Kern | 417/307 |
| 4,990,066 | 2/1991 | Kern | 417/307 |

FOREIGN PATENT DOCUMENTS 0304905 2/1929 United Kingdom .

*Primary Examiner*—Richard E. Gluck
*Attorney, Agent, or Firm*—Ernest G. Szoke; Wayne C. Jaeschke; Kenneth Watov

[57] ABSTRACT

Metering pumps for the metered feed of liquids are fitted with an intake valve built into an intake line from an intake container, a pump chamber downstream of it with a pumping component altering its displacement volume, a pressure valve leading to the metering connector and a vent and by-pass valve built into a return line leading to the intake container. In order to keep the quality of by-passed metering liquid as small as possible while maintaining adequate venting, there is valve chamber between the pressure valve and the pump chamber and separated from the latter by a return valve and a movable control wall, in which is incorporated the vent controlled by the control wall, opening on the suction stroke of the pumping component and closing on its delivery stroke. .There is also preferably in the valve chamber a prestressed displacement wall altering the volume of the valve chamber in the opposite direction to that of the control wall.

15 Claims, 2 Drawing Sheets

METERING PUMP WITH A VENT VALVE

BACKGROUND

1. Field of the Invention

This invention relates generally to fluid pumps, and more particularly to metering pumps for measuring the delivery of liquids.

2. Discussion of Related Art

A prior metering pump is taught in U.S. Pat. No. 3,680,985. It is in the form of a piston diaphragm pump comprising a comparatively large pump chamber with a suction valve in its lower part, and a vent valve in its upper part, and a comparatively small metering cylinder separated from the pump chamber by a metering piston. The metering piston is seated centrally on a transport diaphragm forming the pump element, and designed to be driven back and forth. A pressure valve branches off from the metering piston to the metering line connector. During the particular compression stroke of the transport diaphragm which corresponds to the metering stroke of the metering piston, a majority of the liquid present in the pump chamber—together with any air present therein—is returned through the return line to the intake container via the vent, and a bypass valve arranged in the upper part of the pump chamber because the displacement volume of the transport diaphragm is several times the displacement volume of the metering piston. This large bypass section not only increases the energy consumption of the pump, it is also responsible for increased wear on important parts of the pump, particularly on the suction and pressure valve.

SUMMARY OF THE INVENTION

One object of the present invention is to provide an improved metering pump with adequate venting of the liquid to be metered, for enabling the necessary return flow of liquid through a vent and bypass valve kept as small as possible, for minimizing the drive energy and the susceptibility to wear.

With the problems of the prior art in mind, the present invention provides an improved metering pump by including between the pressure valve and the pump chamber, a valve chamber separated from the pump chamber by a central nonreturn valve and a displaceable control wall. The vent valve is installed in and controlled by the control wall. The vent valve opens during the suction stroke of the pump element, and closes during the compression stroke thereof. Accordingly, the invention provides a metering pump in which adequate venting of the liquid to be metered, particularly during the startup phase of the pump, is achieved via the valve chamber and the vent and bypass valve branching off therefrom without any need for a significant portion of the liquid taken into the pump chamber and displaced therefrom by the pump element to be returned to the intake container via the vent and bypass valve. Instead, the present metering pump is operated in such a way that after the initial intake and venting phase, virtually the entire volume of liquid transported by the pump element to be metered, is forced into the metering line connector via the pressure valve, while maintaining permanent automatic venting of the valve chamber via its vent and bypass valve independent of the magnitude of metering counter-pressure.

In another embodiment of the invention, a movable displacement wall under pressure is provided in the valve chamber and changes the volume thereof in the opposite direction to the control wall. This ensures that no back suction to the valve chamber is able to occur through the vent and bypass valve, during operation including the particular suction stroke of the pump element, the associated intake movement of the control wall, and the resulting opening of the vent and bypass valve. Such operation occurs at times when the displacement volume of the displacement wall acting as a diaphragm is not as great as the displacement volume of the control wall which also functions as a diaphragm. The displacement volume of the pump element, preferably consisting of a transport diaphragm designed to be driven back and forth, is always greater than that of the control diaphragm, and is preferably greater than twice the displacement volume of the control diaphragm.

The control wall together with the central valve and the vent valve, relative to the pressure valve and the displacement diaphragm, are oppositely arranged in the valve chamber in the upper part or lower part thereof or on the left and right thereof. The central valve is preferably integrated in the control diaphragm. To accomplish this, the control diaphragm is provided with a centrally located valve sleeve, comprising the valve bore and the valve seat of the central valve. A support sleeve is screwed to the valve sleeve for providing the valve body of the vent valve, which is connected to the support sleeve by individual support arms.

In a preferred embodiment of the invention, a compression spring acts on a valve body in the form of a ball, included in the pressure valve leading to the metering line connector for placing the ball under a pressure of about 1 bar. If another compression spring acts on the displacement diaphragm, placing it under a pressure of about 0.5 bar, a favorable buildup of pressure in the valve chamber is obtained after adequate venting thereof. Such venting is provided by several successive suction and compression strokes of the diaphragm pump, for causing the displacement diaphragm to be pressed onto its stop against a spring keeping it under pressure, with the pressure valve being open during the particular compression stroke of the transport diaphragm. To the contrary, during each suction stroke of the transport diaphragm, only a comparatively small bypass volume, equal to the difference between the displacement volumes of the displacement wall and the control diaphragm, is forced back to the intake container through the opening of the vent and bypass valve and the return line.

BRIEF DESCRIPTION OF THE DRAWINGS

Various embodiments of the present invention are described and shown herein with reference to the drawings, in which like items are identified by the same reference designation, wherein.

DETAILED DESCRIPTION OF THE INVENTION

Figure 1:
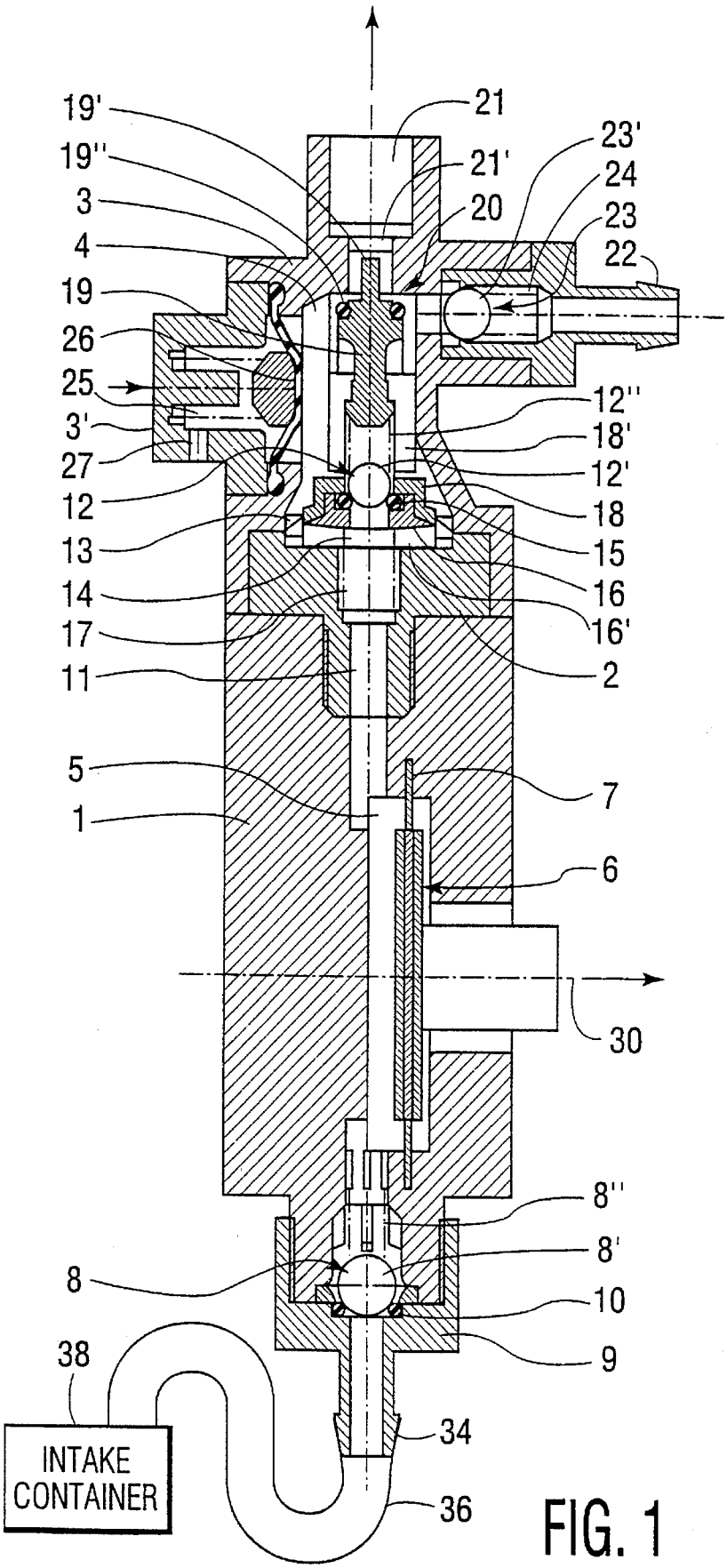
FIG. 1 shows a vertical cross section of the present metering pump in its suction mode.
Figure 2:
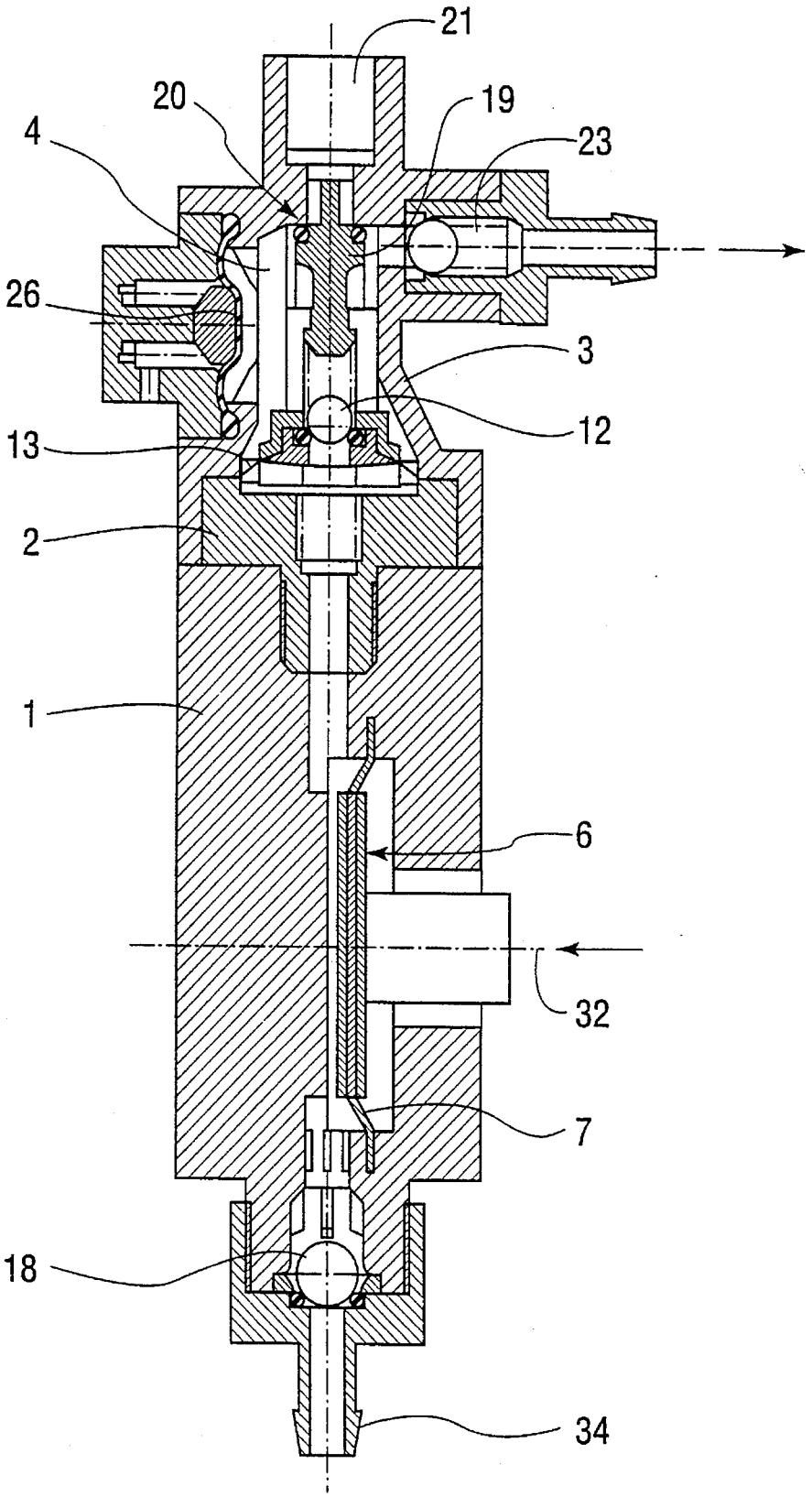
FIG. 2 shows a vertical cross section of the present metering pump in its compression mode.

With reference to FIGS. 1 and 2, the present metering pump is provided with a main housing 1, and a valve housing 3 screwed to the main housing 1 via an intermediate element 2. The assembly provides therein a valve chamber 4.

The main housing 1 includes the pump chamber 5 with a pump element 6 mounted therein. The pump element 6 consists of a transport diaphragm 7 designed to be driven back and forth in the arrowed directions 30, 32 (see FIGS. 1 and 2). The drive motor required for this purpose is not shown. Provided in the lower part of the pump chamber 5 is a suction valve 8 including a valve body in the form of a valve ball 8' that rests on, or is pressed by a compression spring 8" against, the seat seal 10 disposed in a tube-like connector 9. An intake line 36 coming from an intake container 38 which holds the liquid to be metered is designed to be coupled to the connector 9 via port 34.

The pump chamber 5 is designed to be connected to the valve chamber 4 via bore 11. The bore 11 extends centrally through the intermediate element 2 and the central nonreturn valve 12, into valve chamber 4. In the closed position of a central nonreturn valve assembly 12, the pathway of bore 11 is blocked or closed, preventing fluid flow from pump chamber 5 to valve chamber 4. The same purpose is also served by the control wall 13 in the form of a diaphragm in which the central nonreturn valve 12 is integrated and which is installed between the intermediate element 2 and the lower part of the valve housing 3. To this end, the control diaphragm 13 is centrally provided with a valve sleeve 16, which forms the valve bore 14 and the valve seat 15, and which rests via arms 16' present on its underneath on the intermediate element 2 in such a way that the control diaphragm 13 is always fully exposed to the liquid pressure prevailing in the central bore 11. A compression spring 17 slightly larger in diameter than bore 11, is arranged in the upper part of the central bore 11, for urging the control wall or diaphragm 13 towards the valve chamber 4. The valve sleeve 16 is screwed to the support sleeve 18 with the inner parts of the control diaphragm 13 in between. The support sleeve 18 has support arms 18' which join the control diaphragm 13 or rather its support sleeve 18 to the valve body 19 of the vent and bypass valve generally denoted by reference 20. To this end, the lower end of the valve body 19 is captively engaged like a barb between the upper ends of the support arms 18'. It is additionally held therein by the compression spring 12", which rests on the bottom of the valve body 19, and which presses the valve ball 12' of the central valve 12 against the valve seat 15 thereof. The compression spring 12" and the valve ball 12' are accommodated in the space between the opposing support arms 18', which space is in permanent communication with the actual valve chamber 4 via the spaces present between the support arms 18' or rather is part of the valve chamber 4. The function of the compression spring 12" is to guarantee the valve function. However, it may even be omitted if the valve ball 12' is kept in the closed position under its own weight.

The connecting bore 21 for a return line leading to an intake container (not shown) is present in the upper part of the valve housing 3. The valve body 19 engages with its upper, for example cruciform, guide projection 19' in the narrower part 21' of the bore 21. In addition, the sealing ring 19" is arranged on the valve body 19, and co-operates with the wall of the narrower part 21' of the bore 21 which forms the surface of the valve seat.

Branching off from the upper, right-hand side of the valve chamber 4 is a line leading to the metering line connector 22 and incorporating the pressure valve 23, which is also in the form of a valve ball 23' under the pressure of a compression spring 24. The valve ball 23' is placed under a pressure of about 1 bar by the compression spring 24.

A displacement wall 26 in the form of a diaphragm under the pressure of the compression spring 25 is arranged on the opposite side of the pressure valve 23, and is capable of altering the volume of the valve space 4 in the opposite direction to the control diaphragm 13. The displacement diaphragm 26 is placed under a pressure of about 0.5 bar by the compression spring 26. The displacement volume of the displacement diaphragm 26 is equal to or slightly larger than the displacement volume of the control diaphragm 13. The space accommodating the compression spring 25 communicates with the outside atmosphere through the vent bore 27.

Through the suction movement of the transport diaphragm 7 in the arrowed direction 30 in FIG. 1, the liquid to be metered and any air present therein are taken in via the suction valve 8, the control diaphragm 13 with the central valve 12 present therein and the valve body 19 of the vent and bypass valve 20 being drawn downwards against the force of the spring 17 under the effect of the reduction in pressure occurring in the pump chamber 5, so that the vent valve 20 opens as shown in FIG. 1. By contrast, during the subsequent compression stroke of the transport diaphragm 7 (see arrow 32 in FIG. 2), the vent valve 20 is closed by the lifting movement of the control diaphragm 13 so that the pressure which the transport diaphragm 7 is intended to reach builds up in the valve chamber 4. During the next suction movement of the transport diaphragm 7, both the control diaphragm 13, and the valve body 19 of the vent valve 20, are again drawn downwards under the effect of the difference in pressure occurring between the pump chamber 5 and the valve space 4. The air present in the valve space 4 and, initially, the liquid to be metered, which is displaced by the transport diaphragm 7, being forced back through the opening valve 20 and connecting bore 21 into the container holding the liquid via the return line. However, after several suction and compression strokes of the transport diaphragm 7, the valve chamber 4 is adequately vented. A corresponding pressure of the liquid to be metered has built up in the valve chamber 4 and, ultimately, forces the displacement diaphragm 26 onto its stop (see FIG. 2) and opens the pressure valve 23 against its compression spring 24. With every following suction stroke, during which the vent valve 20 opens, any air still present in the liquid to be metered can be removed, irrespective of the metering counter-pressure. In addition, a certain bypass volume can be forced back into the return line or bore 21 by virtue of the fact that the displacement diaphragm 26 is lifted off its stop under the pressure of its spring 25, and thus displaces liquid upwards from the valve chamber 4 in accordance with its displacement volume minus the displacement volume of the control diaphragm 13. Since the displacement volume of the displacement diaphragm 26 is at least as large as, but preferably only slightly larger than, that of the control diaphragm 13, no back suction or back flow into the valve chamber 4 can occur in the open position of the vent and bypass valve 20. The displacement volume of the displacement diaphragm 26 can be adjusted by changing the compression of the spring 25, for example by designing the base 3', which forms the spring support, of the cup-shaped valve housing 3 for adjustment by screwing, in which case the base 3' forms an adjustment screw accessible from outside. Under the effect of the compression spring 8" present in the suction valve 8, a strictly defined pressure difference between the valve chamber 4 and the pump chamber 5 is established, during the movement of the transport diaphragm 7 in the presence of counter-pressure in the suction valve, thus increasing the switching precision of the vent arrangement.

The present invention lends itself to various modifications. For example, the central valve 12 does not have to be integrated in the control diaphragm 13. Instead, it may even be separate from the control diaphragm 13 and arranged between the valve chamber 4 and the pump chamber 5. In that case, the control diaphragm 13 would have to be a continuous diaphragm although it would still control the valve body 19 belonging to the vent valve 20. In addition, the control diaphragm 13 could even be replaced by a control piston with a groove or O-ring as a sealing element, which would form the control wall and would have to be arranged accordingly. The same also applies to the displacement diaphragm 26, which could be replaced by a correspondingly designed and arranged displacement piston.

What is claimed is:

1. A metering pump for measuring the amount of liquids being delivered to an intake container, comprising:

an intake line at one end for connection to an intake container;

a suction valve installed in said intake line;

a pump chamber have one end opening into said intake line for series connection therewith, and another end;

a pump element mounted in said pump chamber for alternately changing the displacement volume of said pump chamber;

a non-return valve;

a valve chamber having one end separated from and coupled to said pump chamber via said non-return valve located therebetween;

a first displaceable wall mounted between said nonreturn valve and said pump chamber;

a vent valve mounted in said valve chamber, said vent valve being controlled by said first displaceable wall, whereby said vent valve opens during a suction stroke of said pump element, and closes during a compression stroke thereof;

a metering line connector having a liquid flow path opening into said valve chamber proximate said vent valve; and a pressure valve mounted in the liquid flow path of said metering line connector, and responsive to the pressure in said valve chamber exceeding a given value for opening to permit liquid to flow therebetween.

2. A metering pump as claimed in claim 1, further including a second displaceable wall under pressure being mounted in the valve chamber for changing the volume thereof in the opposite direction to said first displaceable wall.

3. A metering pump as claimed in claim 1, wherein said first displaceable wall is in the form of a control diaphragm.

4. A metering pump as claimed in claim 3, wherein the pump element consists of a transport diaphragm which is designed to be driven back and forth, and the displacement volume of the transport diaphragm is greater than that of said control diaphragm.

5. A metering pump as claimed in claim 4, wherein the displacement volume of said transport diaphragm is greater than twice the displacement volume of the control diaphragm.

6. A metering pump as claimed in claim 2, wherein the first displaceable wall together with said non-return valve and said vent valve, and the pressure valve and the second displaceable wall, are oppositely arranged in the valve chamber at the top and bottom thereof or on the left and right thereof, respectively.

7. A metering pump as claimed in claim 3, wherein said non-return valve is integrated in said control diaphragm.

8. A metering pump as claimed in claim 7, further including the control diaphragm being centrally provided with a valve sleeve comprising a valve bore and a valve seat of the non-return valve, and with a support sleeve connected to the valve seat for a valve ball of the vent valve the support sleeve also being connected to opposing individual support arms between which said valve ball is free to move and captively retained.

9. A metering pump as claimed in claim 8, further including a valve body of said vent valve having one end captively and slideably retained by said support arms, and a compression spring located within said support arms between the one end of said valve body and said valve ball of said non-return valve.

10. A metering pump as claimed in claim 9, wherein said valve body is captively engaged like a barb between the upper ends of said support arms, and is supported underneath by said compression spring acting on said ball of the non-return valve.

11. A metering pump as claimed in claim 3, further including a compression spring that acts on the control diaphragm, and urging it towards said valve chamber.

12. A metering pump as claimed in claim 4, further including a first compression spring acting on said pressure valve in the form of a ball, placing it under a pressure of about 1 bar, while a second compression spring is acting on said second displaceable wall, placing it under a pressure of about 0.5 bar.

13. A metering pump as claimed in claim 12, wherein the displacement volume of the second displaceable wall is adjusted by altering the compression of the spring.

14. A metering pump as claimed in claim 3, wherein the nonreturn valve is integral with the control diaphragm, and is arranged between the pump chamber and the connecting bore.

15. A metering pump as claimed in claim 1, wherein said suction valve includes a ball and valve seat, and is under the influence of a compression spring positioned for pressing said ball against the valve seat.

* * * * *